United States Patent [19]

Richter et al.

[11] 4,325,436

[45] Apr. 20, 1982

[54] HAMMER DRILL OR CHIPPING HAMMER DEVICE

[75] Inventors: Martin Richter, Freising; Wolfgang Regelsberger, Munich, both of Fed. Rep. of Germany

[73] Assignee: Hilti Aktiengesellschaft, Schaan, Liechtenstein

[21] Appl. No.: 143,856

[22] Filed: May 21, 1980

[51] Int. Cl.[3] ..... B25D 11/04; B25D 11/06

[52] U.S. Cl. ..... 173/13; 173/118

[58] Field of Search ..... 173/13, 14, 47, 48, 173/109, 116, 118; 74/12 A, 22 R

[56] References Cited

U.S. PATENT DOCUMENTS 3,301,550 1/1967 Reinecke ..... 74/22 X
3,841,418 10/1974 Biersack ..... 173/109

FOREIGN PATENT DOCUMENTS 2655899 6/1978 Fed. Rep. of Germany ..... 173/118
2807925 8/1979 Fed. Rep. of Germany ..... 173/48
7806873 1/1979 Netherlands ..... 173/116
588632 6/1977 Switzerland ..... 173/116
1484659 9/1977 United Kingdom .

*Primary Examiner*—Wm. Carter Reynolds
*Attorney, Agent, or Firm*—Toren, McGeady & Stanger

[57] ABSTRACT

In a device which can be used as a hammer drill or a chipping hammer, a percussion mechanism is located within a working cylinder in the housing of the device. A tool can be placed in one end of the working cylinder and the tool can be rotated without any percussive action or it can be given a combined rotative and percussive action. The percussive action is transmitted over a driving mechanism to an actuating piston which reciprocates a percussion piston through an intermediate air cushion. The drive mechanism includes a driving shaft with a disk pivotally connected to the shaft and in engagement with the actuating piston for selectively effecting the percussive action on the tool.

9 Claims, 2 Drawing Figures

HAMMER DRILL OR CHIPPING HAMMER DEVICE

SUMMARY OF THE INVENTION

The present invention is directed to a device which can be used as a hammer drill or a chipping hammer and includes a percussion mechanism preferably driven by an electric motor. The percussion mechanism is composed basically of an actuating piston supported and reciprocally movable within a working cylinder. The actuating piston transfers the percussive energy through the medium of an air cushion to a percussion piston acting on a tool. The actuating piston is in engagement with a disk mounted on a driving shaft and the disk rotates with the shaft.

Percussion mechanisms driven by an electric motor, as mentioned above, are also called electro-pneumatic systems. Usually, the actuating piston is reciprocated by a crank drive. Since in crank drives the axle of the crank shaft always extends perpendicularly to the axis of the actuating piston, such an arrangement requires a lot of space. If the percussion drive is combined with a rotating drive, then a complicated miter gear unit is needed.

To eliminate these disadvantages, it has been suggested to use a swash-plate instead of the crank drive for reciprocating the actuating piston. As compared to a crank drive, a swash-plate has the advantage that the driving mechanism can be constructed much more compactly.

Known percussion mechanisms have the common disadvantage that the percussive force is not continuously variable. This failing applies to percussion mechanisms with a crank drive as well as to those using a swash-plate.

Therefore, it is the primary object of the present invention to provide a percussion mechanism where the percussive force can be regulated.

In accordance with the present invention, the percussive force is regulated by pivotally supporting a driving disk for the actuating piston on a drive shaft. A control member secured to the drive shaft so that it rotates with it, is axially movable on the shaft and regulates the extent to which the disk is pivoted relative to the axis of the shaft.

With the aid of the control member the disk can be displaced from a neutral position into a working position. In the neutral position the plane of the disk extends perpendicularly to the axis of the driving shaft so that no reciprocating movement is transmitted to the actuating piston. In the working position, the disk can be pivoted to a position where it effects the maximum reciprocating movement of the actuating piston. Intermediate positions of the disk can be established between the neutral position and the maximum pivotally displaced position of the disk. In the neutral position where the actuating piston experiences no reciprocating movement, the total output of the driving motor of the device is available for the rotation of the tool mounted in the device.

With the exception of a position parallel to the axis of the driving shaft, theoretically, the pivot axle of the disk can be in any position. For optimum adjustability of the disk, however, it is practical to arrange the pivot axle extending normally to the axis of the driving shaft. With such an arrangement of the pivot axle depending on the axial movement of the control member it is possible to achieve an optimum pivotal deflection of the disk.

In the operation of the device capable of use as a hammer drill or a chipping hammer, it is advantageous to be able to operate the device in a range from a minimum to a maximum percussive force. To afford such variable percussion operation, it is advantageous if a spring element acts to return the disk to its neutral position from a pivoted working position. The restoring force produced by the spring element is supported by centrifugal force acting on the disk. The spring element can be a compression spring arranged around and coaxially to the driving shaft. A compression spring requires little space and can be easily replaced.

Various embodiments can be provided for the control member. In an especially practical embodiment, the control element is shaped as a drum with its surface facing the disk extending obliquely of a plane normal to the axis of the driving shaft. Such an embodiment makes it very simple to produce the control member. The inclination of the surface of the control member facing the disk is established relative to the pivot axle of the disk. Accordingly, for the maximum deflection of the disk, it is possible that the facing surfaces of the control member and the disk are in contact.

Axial movement of the control member can be effected in different ways from the exterior of the device. In a particularly practical embodiment, however, the movement of the control member is achieved by supporting the working cylinder so that it is axially movable. The working cylinder is moved by pressing one end of the cylinder against another surface so that it is moved in its axial direction against the force of a spring. When the force displacing the working cylinder is removed, the spring effects the return of the working cylinder. Normally, the displacement is effected by pressing the device including the working cylinder against a workpiece. When the device is lifted off the workpiece, the spring biased displacement of the working cylinder assures that further percussive action is prevented. In this arrangement, the working cylinder is in operative contact with the control member.

Hammer drills are often used for work involving purely rotational movement. To prevent any percussive force in the device when only rotational movement is desired, it is advantageous if an adjustable stop for the working cylinder is provided. The stop is arranged so that in one position it prevents any axial movement of the working cylinder while in another position it permits axial movement of the working cylinder for axial displacement of the control member along the driving shaft. Therefore, the stop assures the operation of the device in two operating conditions, "rotation only" and "rotation-percussion."

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
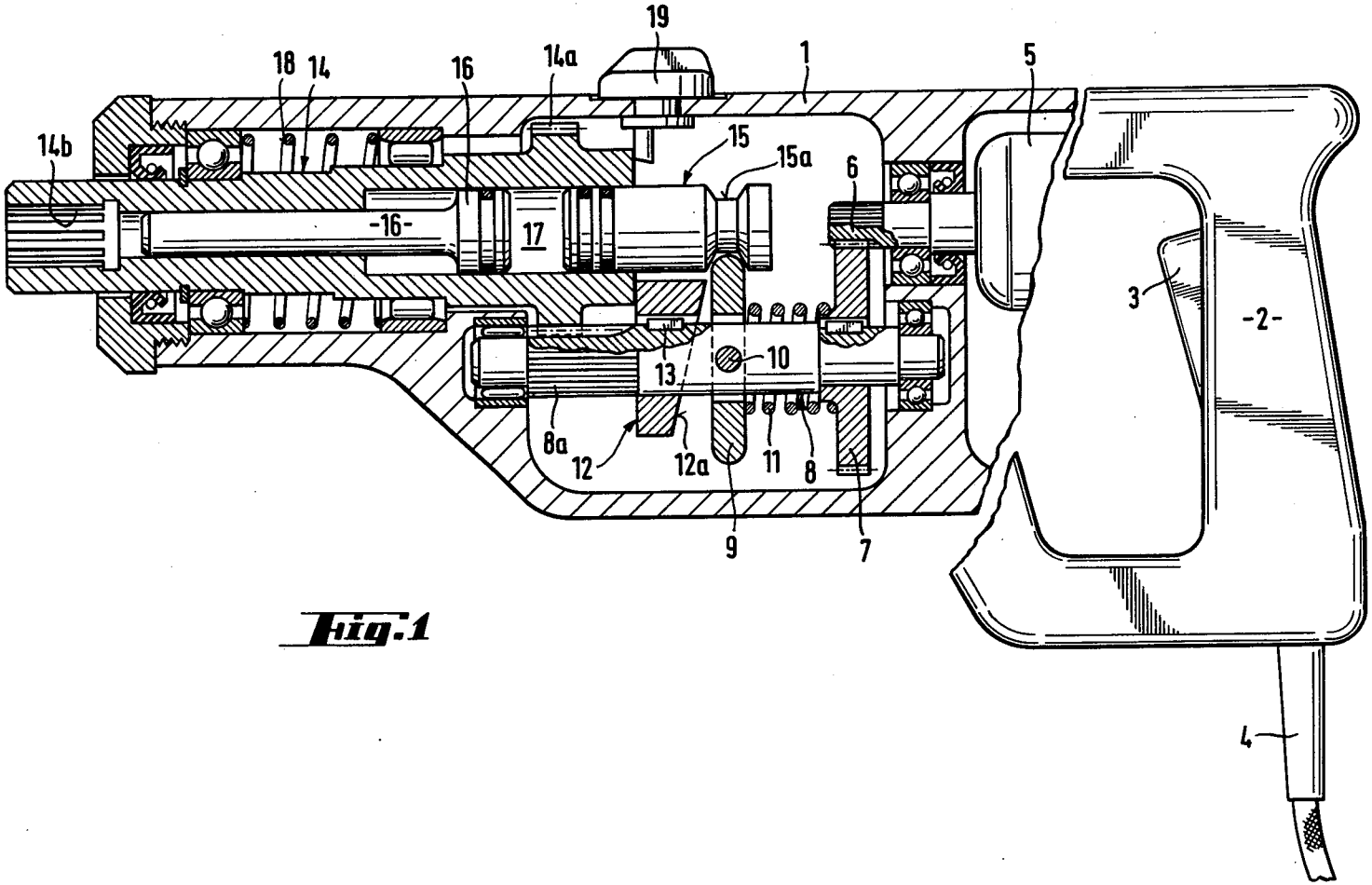
FIG. 1 is a side view of a device useful as a hammer drill or a chipping hammer, partly in section, with the device illustrated in the "rotation only" operating condition.

The device shown in FIG. 1, capable of being used as a hammer drill or a chipping hammer, includes a housing 1 having a handle 2 at its right-hand end as viewed in the drawing. A trigger-like switch 3 and an electrical connection line 4 are provided in the handle 2. As viewed in FIG. 1, the left-hand end of the device is its front end and its right-hand end is its rear end. In the rear portion of the housing 1 an electric motor 5 is located. A shaft extends from the electric motor 5 toward the front end of the housing and the front end of the shaft is constructed as a pinion 6. Pinion 6 is in meshed engagement with a gear 7 secured on a driving shaft 8, with the axis of the shaft 8 extending in the rear end-front end direction of the housing. Consequently, the driving shaft 8 is driven via the pinion 6 and the gear 7. On the shaft 8, forwardly of the gear 7, is an annular disk 9. Disk 9 is pivotally mounted on the driving shaft about a pivot axle 10 extending perpendicularly of the axis of rotation of the driving shaft 8. The disk 9 is pivotally displaceable about the pivot axle 10 between a neutral position and a number of working positions. In FIG. 1 the disk 9 is shown in the neutral position and it is biased into this position by a compression spring 11 coaxial with and laterally surrounding the shaft 8. Located on the opposite side of the disk 9 from the spring 11 is a control member 12 which is axially movable along the driving shaft 8. The control member 12 is connected to the driving shaft 8 by a wedge 13 so that it rotates with the shaft. The front end of the driving shaft 8 is provided with a tooth or splined arrangement 8*a* extending around the circumference of the shaft.

A working cylinder 14 is located within the housing above the driving shaft 8. The axes of the working cylinder and the driving shaft are disposed in parallel relation. The working cylinder has a front end projecting from the front end of the housing 1 and a rear end located within the housing forwardly of the electric motor 5. An actuating piston 15 is positioned in the rear part of the working cylinder and a percussion piston 16 is located within the working cylinder forwardly of the actuating piston. The adjacent facing surfaces of the actuating piston 15 and the percussion piston 16 are spaced apart forming an air cushion therebetween. Air cushion 17 transfers the reciprocating motion of the actuating piston 15 to the percussion piston 16 so that the percussion piston 16 can transmit percussive force. On the outside surface of the working cylinder 14 near its rear end, an outwardly projecting toothed rim 14*a* is provided, this rim is in meshed engagement with the toothed surface 8*a* on the front end portion of the driving shaft 8. Consequently, the rotation of the driving shaft 8 causes the working cylinder 14 to be rotated due to the meshed engagement of the toothed surface 8*a* and the toothed rim 14*a*. Working cylinder 14 is mounted in the housing 1 so that it can be moved for a limited distance in its axial direction. In the neutral position of the device illustrated in FIG. 1, the working cylinder 14 is kept in a forward position by means of a compression spring 18 encircling the working cylinder. Due to an adjustable stop 19 mounted in the housing with a projection extending into the axial path of movement of the working cylinder, it is possible to secure the working cylinder in the position shown in FIG. 1. In this neutral position, it is not possible to cause any reciprocating movement of the actuating piston 15, accordingly, the device is in the "rotation only" operating position. The front end of the working cylinder 14 is designed as a tool carrier 14*b*. When the working cylinder is rotated, a tool secured in the tool carrier 14*b* also rotates.

Figure 2:
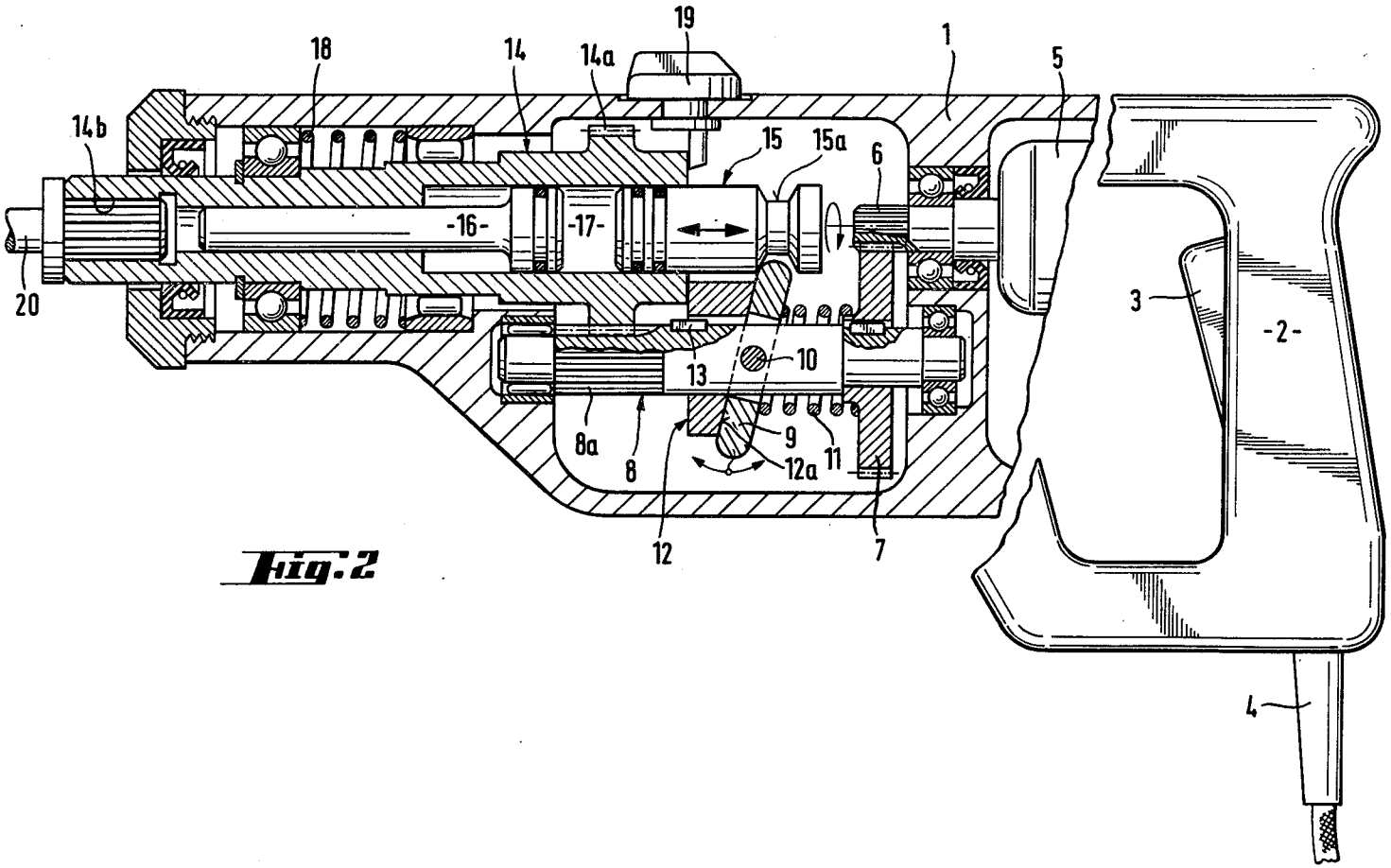
FIG. 2 is a side view, partly in section, of the same device as shown in FIG. 1, however, illustrated in the "rotation-percussion" operating condition.

In FIG. 2, the device illustrated in FIG. 1 is shown in the "rotation-percussion" position. Movement into this second position is achieved by changing the position of the stop 19, as well as by pressing the device against a surface, such as a workpiece. By noting the different positions of the stop 19 in FIGS. 1 and 2, it can be appreciated that in FIG. 2 it is possible to displace the working cylinder 14 axially rearwardly from the position shown in FIG. 1. In FIG. 2, a tool 20 is inserted into the tool carrier 14*b*. With the stop positioned as in FIG. 2, when the front end of the device, that is, the front end of the working cylinder 14, is pressed against a surface, the working cylinder moves axially inwardly into the housing until its rear end contacts the downwardly extending projection on the stop 19. As the working cylinder moves inwardly into the housing, the rear end of the working cylinder in contact with the forwardly facing surface of the control member 12 moves the control member axially relative to the driving shaft 8. The surface 12*a* of the control member facing the disk 9 is inclined obliquely to a plane extending normally of the axis of the driving shaft 8. As the surface 12*a* contacts the disk 9, the disk pivots about its pivot axle 10. Since the disk 9 and the control member 12 rotate in this position with the driving shaft 8, the disk performs a wobbling movement. As it rotates, the disk 9 is engaged within a groove 15*a* in the lateral surface of the actuating piston 15. Due to the wobbling movement of the disk 9 as it rotates, a reciprocating movement is transmitted to the actuating piston 15. Accordingly, in the "rotation-percussion" position shown in FIG. 2, the disk 9 is displaced about the pivot axle 10 to a maximum extent and the reciprocating strokes of the actuating piston are also at a maximum. Between this maximum "rotation-percussion" position and the neutral or "rotation only" position shown in FIG. 1, the angular deflection of the disk 9 and consequently, the percussion stroke, can be varied by changing the contact pressure or the extent to which the disk is angularly deflected. When the device is lifted off the surface, the working cylinder is displaced axially outwardly by the compression spring 18 to the position shown in FIG. 1. Further, the centrifugal force acting on the disk 9 and the effect of the compression spring 11 also act on the disk and through it on the control member, cause the return of the disk to the neutral position of FIG. 1. Therefore, this embodiment of the present invention permits a continuous adaptation of the percussive force acting on the material being processed by the device.

While specific embodiments of the invention have been shown and described in detail to illustrate the application of the inventive principles, it will be understood that the invention may be embodied otherwise without departing from such principles.

What is claimed is:

1. A device for use as a hammer drill or chipping hammer including a housing, an axially elongated working cylinder positioned within said housing and having a front end and a rear end, a percussion mechanism located within said working cylinder, means for operating said percussion mechanism, said percussion mechanism comprising an actuating piston mounted and reciprocally movable within said working cylinder, a percussion piston located within said working cylinder between said actuating piston and the front end of said working cylinder, said percussion piston being spaced axially from said actuating piston forming an air cushion therebetween so that the reciprocating action of said actuating piston is transmitted via the air cushion to said percussion piston, said operating means comprising a driving shaft spaced laterally from said working cylinder, and a disk mounted on said driving shaft and disposed in contact with said actuating piston, wherein the improvement comprises that said disk extends transversely of said driving shaft and includes an axle pivotally connecting said disk to said driving shaft so that the plane of said disk relative to the axis of said driving shaft can be angularly displaced for effecting variable axial displacement of said actuating piston within said working cylinder, and a control member positioned on and rotatable with said driving shaft, and said control member being displaceable in the axial direction of said driving shaft for movement into contact with said disk for pivotally displacing said disk relative to the axis of said driving shaft.

2. Device, as set forth in claim 1, wherein said pivot axle of said disk extends perpendicularly of the axis of said driving shaft.

3. Device, as set forth in claim 1 or 2, wherein a spring element acts on said disk for returning said disk to a position where it is in a plane extending perpendicularly of the axis of said driving shaft.

4. Device, as set forth in claim 1, wherein said control member comprises a drum-like member having a first surface facing said disk and said first surface extending obliquely of the axis of said driving shaft.

5. Device, as set forth in claim 1, wherein said working cylinder being axially displaceable within said housing, the rear end of said working cylinder being movable into contact with said control member for axially displacing said control member along said driving shaft when said working cylinder is moved relative to said housing.

6. Device, as set forth in claim 5, including an adjustable stop mounted on said housing and extending into the path of axial movement of said working cylinder for determining the extent to which said working cylinder is axially movable within said housing.

7. Device, as set forth in claim 1, wherein the axis of said working cylinder and the axis of said driving shaft are disposed in parallel relation, said actuating piston having an annular groove in the outer circumferential surface thereof, said disk extending outwardly from said driving shaft into contact with said actuating piston within the annular groove therein, and said actuating piston having a neutral position wherein it does not experience any reciprocating movement when said disk extends perpendicularly of the axis of said driving shaft.

8. Device, as set forth in claim 7, wherein means located on said driving shaft for biasing said disk into the position where it contacts said actuating piston in the neutral position, said control member located on the opposite side of said disk from said biasing means, and the surface of said control member facing the adjacent surface of said disk is inclined obliquely to a plane extending normally of the axis of said driving shaft.

9. Device, as set forth in claim 8, wherein said working cylinder forms a tool holder at the front end thereof, said percussion piston being axially displaceable through said working cylinder into the range of said tool holder, and spring means in contact with said working cylinder for biasing said working cylinder in the direction outwardly from said housing.

* * * * *